United States Patent [19]

Mori et al.

[11] Patent Number: 4,569,186

[45] Date of Patent: Feb. 11, 1986

[54] BAND-RETURNING AND TIGHTENING APPARATUS FOR A BAND TYPE STRAPPING MACHINE

[75] Inventors: Motoaki Mori; Yuichi Hirose; Hisao Yamaguchi, all of Yokohama, Japan

[73] Assignee: Nichiro Kogyo Co., Ltd., Yokohama, Japan

[21] Appl. No.: 627,609

[22] Filed: Jul. 3, 1984

[30] Foreign Application Priority Data

Oct. 3, 1983 [JP] Japan ..... 58-184832

[51] Int. Cl.[4] ..... B65B 13/22

[52] U.S. Cl. ..... 53/589; 53/582; 100/29; 100/33 PB; 156/502

[58] Field of Search ..... 53/399, 582, 589; 100/29, 32, 33 PB; 156/494, 495, 502, 583.1, 73.4; 226/154, 163, 166

[56] References Cited

U.S. PATENT DOCUMENTS

| | | | |
|---|---|---|---|
| 2,432,014 | 12/1947 | Harrington | 226/154 |
| 3,269,300 | 8/1966 | Billett | 100/8 |
| 4,155,799 | 5/1979 | Matsushita | 156/494 |
| 4,218,969 | 8/1980 | Kasuga | 100/32 |

*Primary Examiner*—James F. Coan

*Attorney, Agent, or Firm*—Oblon, Fisher, Spivak, McClelland & Maier

[57] ABSTRACT

A band type strapping machine comprises a swing lever, pivotally supporting a gripper for gripping a band, adapted to swing according to the rotation of a cam mounted on a cam shaft, a control bar engaged with the swing lever to follow the movement of the swing lever, a driving roller operating to engage with a band tightening roller, the driving roller being strongly brought into contact with the band tightening roller rotated at a low speed, high torque by actuation of a solenoid.

9 Claims, 4 Drawing Figures

BAND-RETURNING AND TIGHTENING APPARATUS FOR A BAND TYPE STRAPPING MACHINE

The present invention relates to a band type strapping machine for winding a package with a thermoplastic band (hereinafter referred to as a band); tightening the band; melt-bonding an overlapping part of the band by heating under pressure and cutting the band. More particularly, it relates to a band-returning and tightening apparatus of the band for the band type strapping machine to return and tighten the band wound around the package in direct and mechanical relation to the movement of a first gripper for clamping an edge of the band in association with a slide table.

In the conventional band type strapping machine, a band is fed toward an arch guide by causing it to pass between a band feeding roller and a free roller or a rocker roller both rotated under engaged condition, then around the package, the band feeding roller is then reversely rotated to tighten the package as soon as the leading end of the band passed through the arch guide has been clamped with a first gripper having a cutter for cutting the band, thereafter the band is clamped by a second gripper at its tightening end side, and next a heating element is inserted between the overlapping part of the band gripped by the first and second grippers with or without tension to melt opposing surfaces of the band and finally the overlapping part of the band is heat-sealed by pressing and cooling it immediately after the withdrawal of the heating element. The band may be cut by the cutter of the first gripper before and after the heat-sealing operation for the band.

Thus, a series of operations of many part of the strapping machine is effected by action of cams, a microlever and solenoids. However, the conventional machine has been still insufficient to effect these operations under taking precise timing.

It is an object of the present invention to provide a band-returning and tightening apparatus for a band type strapping machine performing-under precise timing returning and tightening operations of the band by causing the movement of a first gripper for clamping the band edge in association with a slide table in direct and mechanical relation to the tightening operation of the band.

The foregoing and the other objects of the present invention have been attained by providing a band-returning and tightening apparatus for a band type strapping machine comprising a slide table, a band feeding roller and a band tightening roller both being provided below the slide table and a first gripper for clamping an end of a band wound around the package by the band feeding roller, characterized in that a swing lever pivotally supporting the first gripper, a control bar engaged with the swing lever to follow the movement of the swing lever, a driving roller operating to engage with the band tightening roller in association with the control bar moving on the side of a cam shaft, the driving roller being strongly brought into contact with the band tightening roller rotated at a low speed, high torque by actuation of a solenoid.

A more complete appreciation of the invention and many of the attendant advantages thereof will be readily obtained as the same becomes better understood by reference to the following detailed description when considered in connection with the accompanying drawings, wehrein:

Figure 1:
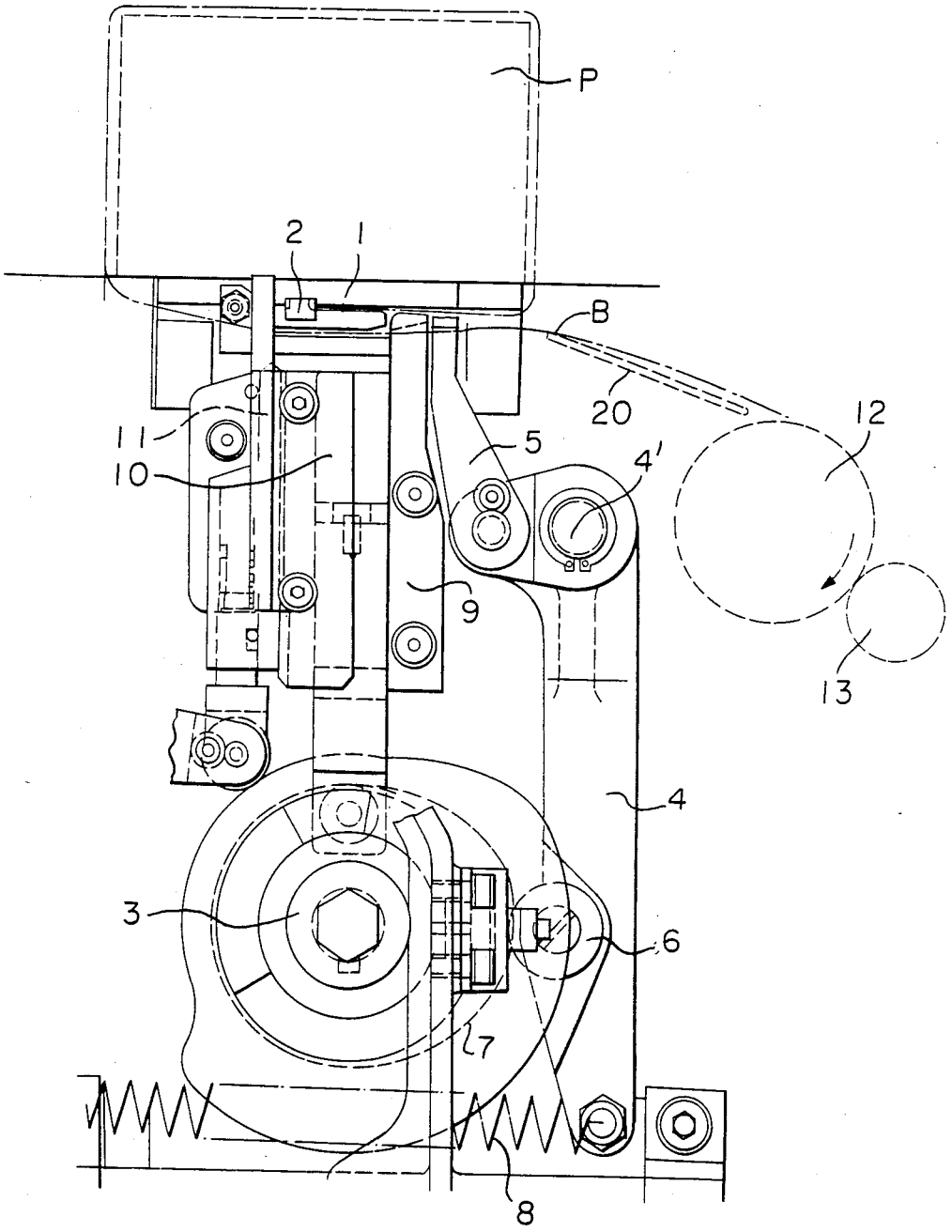
FIG. 1 is a front view showing a main part of a conventional band type strapping machine.

An embodiment of the present invention will be described with reference to drawings.

In FIGS. 1 to 4, a reference numeral 1 designates a slide table of a band type strapping machine on which a package P to be wound with a band B is placed. A microlever 2 is placed beneath the slide table 1 to detect that the leading end of the band B fed to the underneath of the slide table 1 comes in contact with the microlever 2 to thereby rotate a cam shaft 3. The cam shaft 3 is provided with several cams which respectively cause movement of first (right) and second (left) grippers 5, 11, and a seal-press head 10 attached with a cutter 9 whereby operations of returning and tightening of the band B, gripping, melt-bonding and cutting it are sequentially carried out in a usual manner.

There is provided in the strapping machine a swing lever 4 whose upper part is journaled by a pivotal pin 4' and whose lower end is connected to one end of a tension spring 8 which always urges the lower end on the left hand in FIG. 1. The first gripper 5 is pivotally supported at its lower part by the upper portion of the swing lever 4 near its journal point. A roller 6 mounted on the lower part of the swing lever 4 is in contact with a cam 7 mounted on the cam shaft 3 so that when the projecting part of the cam 7 urges the swing lever 4 through the roller 6 so as to be in upright, the first gripper 5 leaves the band B and when the lowered part of the cam 7 comes in contact with the roller 6 the first gripper 5 grips the band. The second gripper 11 functions to grip the end of the band B in association with the slide table 1 in accordance with revolution of a cam mounted on the cam shaft 3 and thereafter the seal-press head is operated; thus, overlapping band is melt-bonded.

A band guide 20 is placed adjacent a tightening roller 12 having a rubber layer on its outer peripheral surface, which is rotated in the arrow mark direction when it is brought into press-contact with a driving roller 13. The driving roller 13 has a minutely roughened outer surface so as not to damage the band B when it causes slippage on the driving roller 13.

Figure 2:
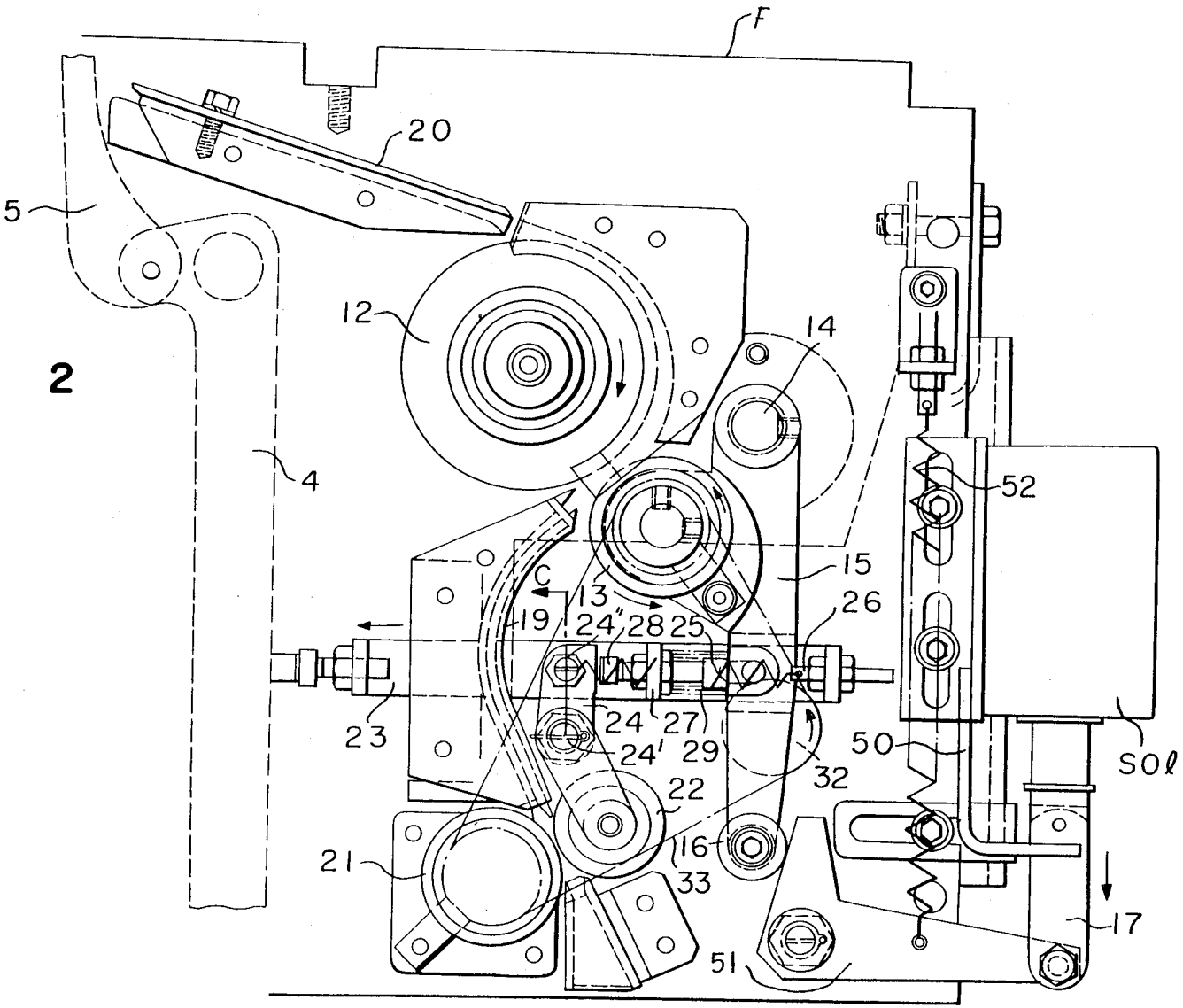
FIG. 2 is a front view showing a main part of an embodiment of the band-returning and tightening apparatus according to the present invention.
Figure 3:
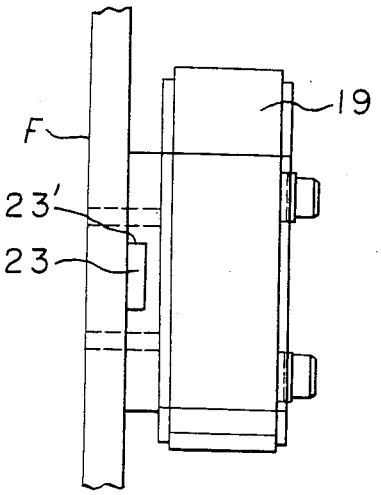
FIG. 3 is a schematic diagram showing a relationship between a band guiding member and a control bar.

In FIG. 2, the driving roller 13 is pivotally supported on a turnable arm 15 at a position near a fixed pin 14 which is secured to a machine frame or a fixed plate F. The lower end of the turnable arm 15 is provided with a roller 16 which is engaged with one end portion of a forked lever 51. The diverging portion of the forked lever is journaled by a pin and the other end of the forked lever 51 is connected with the operating rod 17 of a solenoid (sol) whereas a tension spring 52 extends between the intermediate portion of the forked lever 51 at the side of the solenoid (sol) and the upper part of the forked lever 51 so as to urge it upwardly. A control bar 50 is placed to control movement of the solenoid (sol).

Figure 4:
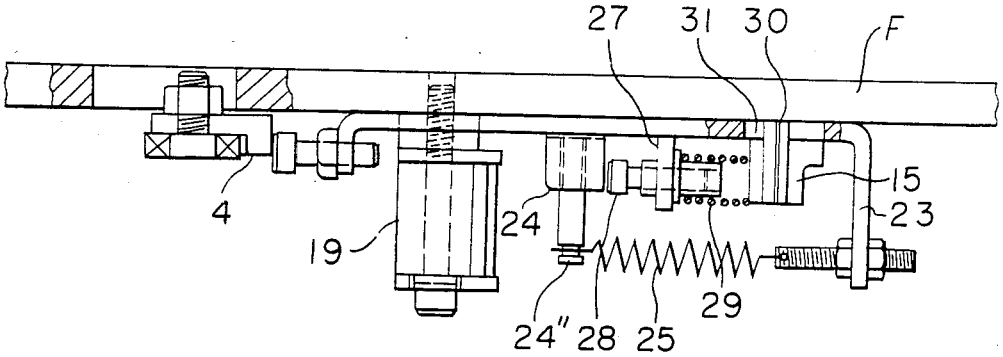
FIG. 4 is a side view partly cross-sectioned of the control bar of the present invention.

A belt 33 is wound around the driving roller 13, a band feeding roller 21 and a pulley of a driving motor 32, the latter two members being also mounted on the frame F. A rocker roller 22 described later is placed in the vicinity of the band feeding roller 21 so as to be engageble and disengageble therewith. Between the band tightening roller 12 and the band feeding roller 21, a separate band guide 19 is placed along a band feeding passage. As specifically shown in FIG. 3, a slot 23' is formed in the band guide 19 at a fitting portion to the frame F and a control bar 23 is inserted into the slot 23' in a laterally slidable manner. One end of the control bar 23 (which may be formed by bending a metal strip in a channel-shape as shown in FIG. 4) is in contact with the swing lever 4 through a length adjusting screw. Alternatively, the control bar 23 may be in direct contact with a cam mounted on the cam shaft 3 so as to cooperate with the movement of the cam 7.

A lever 24 is pivotally held at its intermediate portion by a pin 24' and the lower end of the lever is connected to the shaft of the rocker roller 22 while the upper end is connected to a supporting pin 24" set up on the control bar 23. A tension spring 25 extends between the supporting pin 24" and a threaded pin 26 fitted to the other end of the channel-shaped control bar 23, on account of which the upper end of the lever 24 is always pulled counterclockwisely so that the rocker roller 22 connected to the lower end of the lever 24 is brought into press-contact with the band feeding roller 21. Between the supporting pin 24" and one end of the control bar 23 on the side of the threaded pin 26, a projecting wall 27 extends from the control bar 23. An adjusting bolt 28 is fitted into a threaded hole formed in the projecting wall 27 so that distance between the head of the bolt 28 and the side surface of the lever 24 is adjustable by turning the bolt 28 with respect to the projecting wall 27. The bolt 28 comes into contact with the lever 24 when the control bar 23 is caused to slide on the side of the cam shaft 3.

A compression spring 29 extends between the rear surface of the projecting wall 27 and the turnable arm 15 to urge the turnable arm 15 in the counterclock direction around the fixed pin 14, namely in the direction that the driving roller 13 is away from the band tightening roller 12. As seen in FIG. 4, an elongated groove 31 is formed in the control bar 23 in its longitudinal direction and a pin 30 fixed to and extending from the lower surface of the turnable arm 15 is fitted into the elongated groove 31. The pin 30 is always urged on the right side of the groove 31 by the action of the compression spring 29.

In the next place, operations of the band type strapping machine of the present invention will as described.

The band B is fed through the band guides 19, 20 by means of the band feeding roller 21 driven by the motor 32 and the rocker roller 22 which is made in contact with the feeding roller 21 by the action of the tension spring 25 whereby the band B is caused to pass through the underneath of the slide table 1 to be projected thereabove, and then, is wound around a package P placed on the slide table 1 and is thereafter, is led below the table 1 to push the micro-lever 2. The actuation of the micro-lever 2 stops the motor 32 for feeding the band and at the same time, the cam shaft 3 turns by 60° by which the roller 6 of the swing lever 4 comes in contact with the lowered part of the cam 7, on account of which the swing lever 4 swings around the pivotal pin 4' by the action of the tension spring 8 in the clockwise direction. As a result, the first gripper 5 is raised by the swing lever 4 to clamp the band B in association with the lower surface of the slide table 1.

When the swing lever 4 swings, the control lever in contact therewith moves toward the cam shaft 3 by the action of the tension spring 52 and the forked lever 51, on account of which the bolt 28 fitted to the threaded hole of the projecting wall 27 urges the upper end of the lever 24. The movement of the lever 24 on the side of the cam shaft 3 causes detachment of the rocker roller 22 from the band feeding roller 21 and at the same time, the driving motor 32 is started.

While the control bar 23 moves in the arrow mark direction, the turnable arm 15 swings around the fixed pin 14 on the side of the cam shaft 3 since the pin 30 is always pushed to the rear end of the elongated hole 31 by the compression spring 29; thus, the driving roller 13 is brought into press-contact with the tightening roller 12. The tightening roller 12 is provided so that it rotates in the arrow mark direction, namely the direction of tightening the band in FIG. 2. Accordingly, the band B is returned at a high speed by urging the driving roller 13 rotating at a high speed to the tightening roller 12. As soon as the band circulates around the package, the driving motor 32 stops its revolution by the action of a switch (not shown) and at the same time, an electromagnetic clutch (not shown) transmits a low speed rotational force to the tightening roller 12 (the power of a low speed and a high torque is transmitted by means of a motor and a reduction gear which rotate the cam shaft).

As soon as the low speed, high torque power drives the tightening roller 12, the solenoid sol for tightening and pressing is rendered to be conductive so that a clamping force required to tightening the band is given to the driving roller 13. By a frictional force of the tightening roller 12 around which the band B subjected to a tightening force with the low speed and high torque by the clamping force, a strong tightening force is established on the band without causing slippage of the band B. The tightening force may be determined at the desired value by operating the electromagnetic clutch which transmits the low speed and high torque.

When the band B is strongly tightened, the cam shaft is again driven by actuating a switch (not shown) to initiate the remaining 300° revolution of the cams whereby there take place sequential operations such that a cam raises the second gripper 11 to secure the tightening side of the band B in association with the lower surface of the slide table 1, a heater (not shown) is inserted between overlapping portions of the band B to melt them and the seal-press head 10 is operated to press-bond the band and the cutter 9 cuts it. Namely, in the band feeding and returning operations according to the present invention, the band B is fixed between the first gripper 5 and the slide table 1 when the first gripper 5 is raised. The swing movement of the swing lever 4, at the upper end of which the first gripper 5 is pivotted, is directly related to the lateral movement of the control bar 23. The retracting movement, i.e. movement on the right hand in FIG. 2 of the control bar 23 causes the rocker roller 22 to bring in contact with the band feeding roller 21 to thereby feed the band B, whereas the advancing movement, i.e. movement on the right hand, of the control bar 23 causes the driving roller 13 to bring in contact with the tightening roller 12 to perform band returning operation at a high speed, then the tightening roller 12 is subjected to a rotational force of a low speed and high torque and thereafter, the solenoid (sol) is actuated so that the driving roller 13 freely rotating is strongly brought in press-contact with the tightening roller 12. Thus, two stage strong tightening operations enables smoothly tightening operation of the band. Further, the first gripper is actuated in mechanically related movement of the swing lever whereby reliable band feeding and returning operations can be established.

As described above, according to the band type stripping machine of the present invention, band-returning and tightening operations are carried out in directly mechanical relation to ascending of the first gripper thereby to effect returning and tightening of the band under precise timing. Use of the driving roller allows adjustment of a contating force even in a high speed returning operations. At this moment, it is possible to reduce inertial force of the roller to the minimum level when the band is entirely fitted around the package because any transmittal force is not imparted to the tightening roller. Damage of the package is therefore, avoided.

When the band is to be tightened, a low speed, high torque is directly related to the tightening roller and a strong contacting force is given to the driving roller only at the time of the tightening of the band whereby there is no stress to the band even in the strong tightening operations and is not adversely affected in band feeding operations. Accordingly, it is possible to place the band feeding roller behind the band tightening roller. Even though the band comes off from an archguide, automatic band feeding operations are performed without manual operations such as returning of the band and inserting it which has encountered in the conventional band type strapping machine. Namely, in the conventional apparatus having the band feeding roller placed downstream side of the band tightening roller, the leading end of the band returned sometimes comes off from the band feeding roller which necessitates to insert the band into the band feeding roller by manual operation. The band type strapping machine according to the present invention is useful for automatical strapping operations.

We claim:

1. A band-returning and tightening apparatus for a band type strapping machine comprising a slide table, a band feeding roller and a band tightening roller both being provided below said slide table and a first gripper for clamping an end of a band wound around said package by said band feeding roller, characterized by a swing lever pivotally supporting said first gripper, a control bar engaged with said swing lever to follow the movement of said swing lever, a driving roller operating to engage with said band tightening roller in association with said control bar, said driving roller being strongly brought into contact with said band tightening roller rotated at a low speed and high torque by actuation of a solenoid, wherein said driving roller is pivotally supported on a turnable arm at a position near a fixed around which said turnable arm swings, wherein said control bar is urged toward said swing lever by a tension spring, by means of a forked lever and said turnable arm.

2. The band type strapping machine according to claim 1, wherein said swing lever is engaged with a cam mounted on said cam shaft actuated in response to clamping of said band.

3. The band type strapping machine according to claim 1, wherein said turnable arm is engaged with said control bar in such a manner that a pin fixed to and extended from said turnable arm is fitted in an elongated groove formed in said control bar and a compression spring extends between a projecting wall formed in said control bar and said turnable arm to urge the arm in the counterclockwise direction around said fixed pin.

4. A band-returning and tightening apparatus for a band type strapping machine comprising a slide table, a band feeding roller and a band tightening roller both being provided below said slide table and a first gripper for clamping an end of a band wound around said package by said band feeding roller, characterized by a swing lever pivotally supporting said first gripper, a control bar engaged with said swing lever to follow the movement of said swing lever, a driving roller operating to engage with said band tightening roller in association with said control bar, said driving roller being strongly brought into contact with said band tightening roller rotated at a low speed and high torque by actuation of a solenoid, wherein said control bar is provided with an actuation means for effecting a rocker roller to engage with and disengage from said band feeding roller.

5. The band type strapping machine according to claim 4, wherein said driving roller is pivotally supported on a turntable arm at a position near a fixed pin around which said turnable arm swings.

6. The band type strapping machine according to claim 4, wherein said actuation means is formed of a projecting wall, a bolt fitted to said projecting wall to extend to the upper end of a lever which pivotally supports said rocker roller at its lower end and a tension spring pulling the upper end of said lever on the side of said projecting wall.

7. The band type strapping machine according to claim 4, wherein said swing lever is engaged with a cam mounted on said cam shaft actuated in response to clamping of said band.

8. The band type strapping machine according to claim 5, wherein said control bar is urged toward said swing lever by a tension spring, by means of a forked lever and said turntable arm.

9. The band type strapping machine according to claim 5, wherein said turntable arm is engaged with said control bar is such a manner that a pin fixed to and extended from said turnable arm is fitted in an elongated groove formed in said control bar and a compression spring extends between a projecting wall formed in said control bar and said turnable arm to urge the arm in the counterclockwise direction around said fixed pin.

* * * * *